US005292336A

United States Patent [19]

Spence, Jr. et al.

[11] Patent Number: 5,292,336

[45] Date of Patent: Mar. 8, 1994

[54] PACIFIER WITH HANDLE

[75] Inventors: Meredith Spence, Jr., Cuyahoga Falls; James J. Keane, Aurora, both of Ohio

[73] Assignee: Lisco, Inc., Tampa, Fla.

[21] Appl. No.: 37,139

[22] Filed: Mar. 25, 1993

[51] Int. Cl.[5] ..... A61J 17/00

[52] U.S. Cl. ..... 606/236; 606/234; D24/194

[58] Field of Search ..... 606/234–236; D24/194–199

[56] References Cited

U.S. PATENT DOCUMENTS

| | | | |
|---|---|---|---|
| 4,381,785 | 5/1983 | Robbins | 606/236 |
| 4,554,919 | 11/1985 | Hubert | 606/234 |
| 4,867,159 | 9/1989 | Fulton | 606/236 |

FOREIGN PATENT DOCUMENTS

| | | | |
|---|---|---|---|
| 2466245 | 4/1981 | France | 606/236 |
| 2057274 | 4/1981 | United Kingdom | 606/236 |

*Primary Examiner*—Stephen C. Pellegrino
*Assistant Examiner*—Glenn K. Dawson
*Attorney, Agent, or Firm*—Donald R. Bahr; John E. Benoit

[57] ABSTRACT

A pacifier including a shield having a slot therein for accepting the lips at the end of a nipple which extends outwardly from the shield. The side of the shield opposite the nipple has a circular flange having two spaced slots, each having an entry section and an elongated section extending substantially perpendicular to the entry section and an interior guide borehole between the slots. A U-shaped handle includes a bar across its open end. The bar is inserted into the slots and moved to the internal end of the slots. A cap of a dimension to fit within the circular flange includes two depending fingers which mate with the vertical sections of the slots, a pin which mates with the interior guide borehole, and a depending barb which mates with and passes through the slot in the shield and into the shank of the nipple. The shield and cap are then ultrasonically welded.

6 Claims, 1 Drawing Sheet

PACIFIER WITH HANDLE

The present invention relates generally to pacifiers and more specifically to a pacifier which includes a handle on the opposite side of the shield from the nipple.

Pacifiers have been in use for many years and have taken various shapes and included many components together with the basic shield and nipple. Most pacifiers in use today do not have a handle which is rotatable within the pacifier; they either have a grasping handle integral with the pacifier or no particular handle is used.

It is advantageous to have a handle on the pacifier, particularly a handle which is rotatable within the pacifier, so that a child or an adult can easily carry the pacifier and still use it in its intended fashion.

One of the problems with previous attempts to use a handle in a pacifier is that the handle was inserted in the usual spring mode or the like and under stress conditions could be removed from the pacifier. This presents a danger to a child should he remove the handle and put it in his mouth; there is a great danger that he could swallow it or get it lodged in his mouth and cause serious damage.

Accordingly, it is an object of the present invention to provide a pacifier with a handle that is securely in place and cannot be removed without breaking the entire pacifier.

Another object of the invention is to provide a pacifier which includes a rotatable handle and which also provides a redundancy in securing the handle to the pacifier.

SUMMARY OF THE INVENTION

The present invention provides a pacifier which includes a shield having a slot therein for accepting the end lips of a nipple which extends outwardly from the shield. The side of the shield opposite the nipple has a circular flange having two opposed slots, each of said slots having an entry section extending downwardly from the rim of the flange and an elongated section within the flange extending at substantially a right angle to the entry slot, and an interior guide hole between the slots. A U-shaped handle includes a bar across its open end. The bar is inserted into the slots and moved to the internal end of the slots. A cap of a dimension to fit within the circular flange includes two depending fingers which mate with the vertical sections of the slots, a pin which mates with the interior guide borehole, and a depending barb which mates with and passes through the slot in the shield and into the shank of the nipple. The shield and cap are then secured together by means such as ultrasonic welding.

DESCRIPTION OF THE PREFERRED EMBODIMENT

Figure 1:
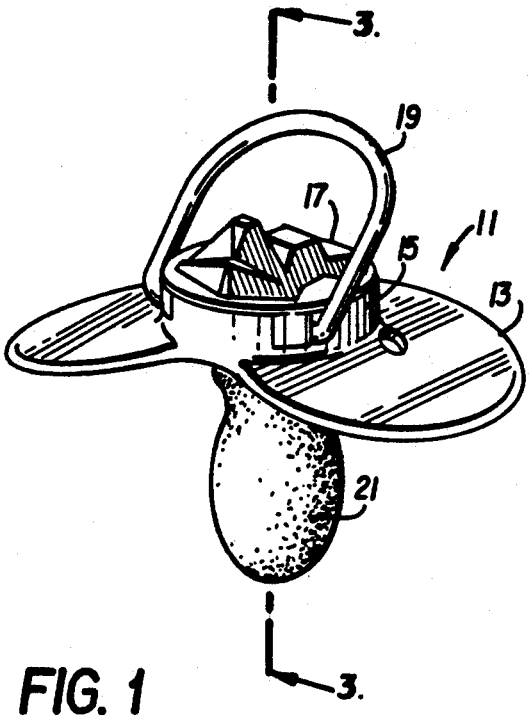
FIG. 1 is a perspective view of one embodiment of the present invention.
Figure 2:
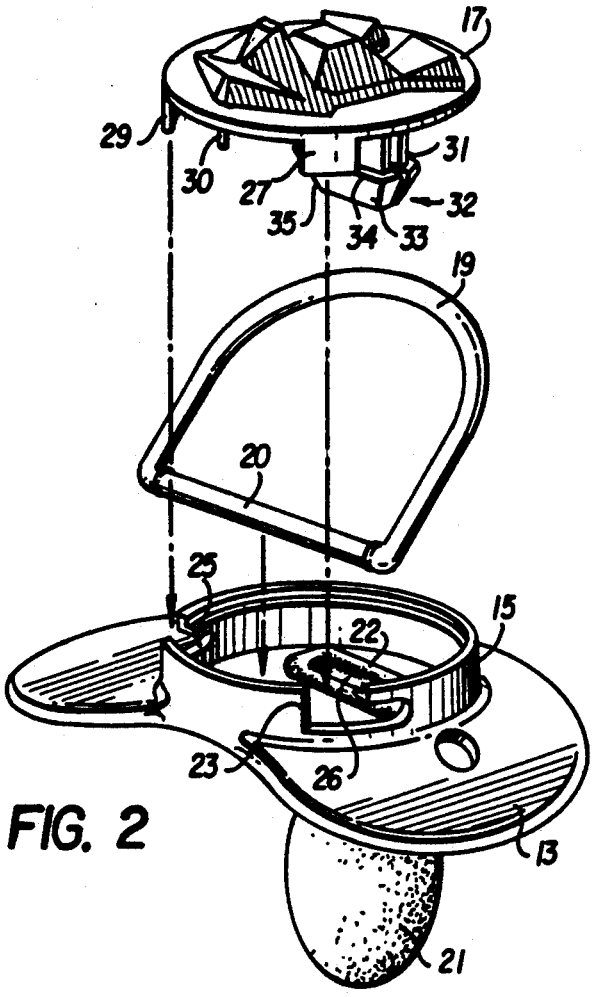
FIG. 2 is an exploded view of the elements used in the pacifier of FIG. 1.
Figure 3:
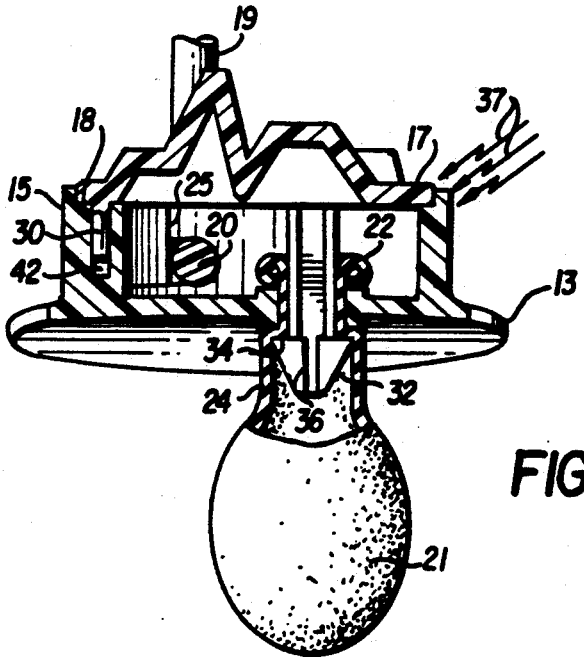
FIG. 3 is a sectional view taken along the lines 3—3 of FIG. 1.

Referring collectively to FIGS. 1, 2, and 3, there is shown pacifier 11 which includes shield 13, a continuous flange 15 illustrated here as a circular flange, cap 17, handle 19, and nipple 21.

The exploded view of FIG. 2 shows in detail the components of the pacifier of FIG. 1. As shown, shield 13 and flange 15 are integral and slot 22 extends through that part of the shield enclosed by flange 15. Nipple 21 terminates in lip 22, which has been passed through slot 26 and is shown resting basically against the upper surface of the shield.

Flange 15 includes L-shaped slot 23 and J-shaped slot 25. These slots are basically mirror images of each other and are spaced at a particular distance about the periphery of flange 15.

Handle 19 is C-shaped and includes bar 20, which is secured between the open ends of the C-shaped handle. When handle 19 is lowered into slots 23 and 25 it is then moved to the ends of the inner part of the slot so as to be free of the vertical portion of the slot.

Cap 17 includes depending fingers 27 and 29, which are of a dimension to mate with the vertical portions of slots 23 and 25. Cap 17 also has a depending peg 30 which mates with borehole 42 and the wall of flange 15, as more clearly shown in FIG. 3.

Barb 31 is integral with cap 17 and depends downwardly therefrom and terminates in section 32 having cammed surfaces 33 at the ends and sides thereof, and includes upper shoulders 34. The width of surface 32 at the shoulders is slightly greater than the width of slot 26

The pacifier is assembled by lowering bar 20 of handle 19 into the slots and moving it rearwardly within the slots, as described above. Nipple 21 has its lip portion 22 inserted through slot 26. Cap 17 is then placed within flange 15 and is supported therein by ledge 18. When cap 17 is lowered into position, fingers 27 and 29 mate with the vertical portions of J-shaped slot 23 and J-shaped slot 25; and lower portion 32 of barb 31 passes through slot 26 and into shank 24 of nipple 21. This completed construction is shown more clearly in FIG. 3.

As indicated in both FIGS. 2 and 3, lower portion 32 is partially split by providing channels 36 at either end thereof. This permits lower portion 32 to flex somewhat inwardly as the cammed surfaces are passed through slot 26, whereby shoulders 34 expand after passing through the slot so as to secure the nipple in place by an interference action which effectively locks the nipple and prevents it from being removed from the pacifier.

After the parts are assembled, cap 17 is secured to flange 15 by means such as ultrasonic welding indicated at 37.

As will be obvious from the above description and drawings, the final assembly, including the handle with rod 20 being retained in the slots as shown, together with the ultrasonic welding of the cap to the shield, and the further retention of the cap by the interference of the barb being inserted into the shield, provides excellent redundancy for handle-retention strength. Additionally, the construction of the pacifier requires only three molded pieces and the nipple and, therefore, is economically produced.

The above description and drawings are illustrative only since it is quite obvious that various components could be modified, such as the dimensions of the slot and mating barb, without departing from the invention, the scope of which is to be limited only by the following claims.

We claim:

1. A pacifier comprising a substantially rigid shield;

a slot passing through said shield;

a substantially circular flange extending outwardly from one side of said shield and terminating in an upper rim, said slot being within an area of said shield enclosed by said flange;

a first slot in said flange having an entry section extending downwardly from said upper rim of said flange and an elongated section within said flange extending at substantially a right angle to said entry section;

a second slot in said flange having an entry section extending downwardly from said upper rim of said flange and an elongated section within said flange extending at substantially a right angle to said entry section, said second slot being spaced from said first slot;

a C-shaped handle having a bar secured to and interconnecting the open ends of said C-shaped handle with open ends, said bar resting within said elongated sections of said first and second slots and extending outwardly of said flange;

a nipple having a shank and lips, said shank extending through said slot passing through said shield with said lips located within said area of said shield enclosed by said flange;

a cap having periphery and a dimension to mate with and be retained by said flange;

a barb including shoulders which are wider than said slot passing through said shield, said barb extending downwardly from said cap, said barb extending through said slot passing through said shield within said shank of said nipple wherein said shoulders bear against said shank and said shield so as to provide an interference fit between said barb, said shank, and said shield;

a pair of fingers extending downwardly from the periphery of said cap, one of said fingers mating with the entry section of said first slot in said flange and the other of said fingers mating with the entry section of said second slot in said flange; and means for securing said cap and said fingers to said continuous flange.

2. The pacifier of claim 1 further comprising a borehole in an wall of said flange between said first and second slots in said flange; and a peg integral with said cap and extending downwardly from said cap into said borehole.

3. A pacifier comprising a shield;

a slot in said shield;

a substantially circular flange integral with and extending outwardly from one side of said shield and terminating in an upper rim, said slot being located within the area of said shield enclosed by said flange;

a C-shaped handle with open ends having a bar connected between the open ends of said C-shaped handle;

two opposed slots in said flange, each of said slots having an entry section extending downwardly from said upper rim of said flange and an elongated section within said flange extending at substantially a right angle to said entry section, said bar passing through said slots and movably retained in said elongated sections, a nipple having a shank terminating in a lip, said shank passing through said slot in said shield and said lip being on said one side of the shield;

a cap secured to said upper rim of said flange; and a barb integral with said cap and extending into said nipple shank and through said slot in said shield.

4. The pacifier of claim 3 wherein said slot in said shield is elongated and said barb is partially split and includes shoulders which are wider than the width of said slot.

5. The pacifier of claim 3 further comprising a borehole in a wall of said flange; and a peg integral with said cap extending into said borehole.

6. The pacifier of claim 3 further comprising a pair of fingers extending downwardly from said cap and adapted so as to mate with said entry sections of said slots in said flange.

* * * * *